US006377003B1

(12) United States Patent
Chen et al.

(10) Patent No.: US 6,377,003 B1
(45) Date of Patent: Apr. 23, 2002

(54) MULTI-BEAM GROUP ELECTRON GUN FOR BEAM INDEX CRT

(75) Inventors: Hsing-Yao Chen, Barrington, IL (US); Chun-Hsien Yeh, Taipei (TW)

(73) Assignee: Chungwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 09/835,929

(22) Filed: Apr. 16, 2001

(51) Int. Cl.[7] ..... G09G 1/04

(52) U.S. Cl. ..... 315/382.1; 315/5; 315/5.14; 315/5.31; 313/409; 313/447; 313/414

(58) Field of Search ..... 315/382.1, 382, 315/5, 5.14, 5.49, 5.39, 5.31; 313/15, 414, 409, 447, 411, 412, 413

(56) References Cited

U.S. PATENT DOCUMENTS

| | | | | |
|---|---|---|---|---|
| 3,524,094 A | | 8/1970 | Hasker et al. | |
| 3,801,817 A | | 4/1974 | Goodman | 250/365 |
| 4,177,462 A | | 12/1979 | Chung | 340/703 |
| 4,193,071 A | | 3/1980 | Hasegawa et al. | 340/723 |
| 4,225,880 A | | 9/1980 | Goodman | 358/66 |
| 4,234,814 A | | 11/1980 | Chen et al. | 313/412 |
| 4,247,869 A | | 1/1981 | Culter et al. | 358/67 |
| 4,408,223 A | | 10/1983 | Midland | 358/67 |
| 4,439,735 A | | 3/1984 | Avite et al. | 324/404 |
| 4,507,585 A | | 3/1985 | Inoue et al. | 313/471 |
| 4,635,106 A | | 1/1987 | Shinkai | 358/68 |
| 4,701,677 A | | 10/1987 | Ashizaki et al. | 315/382 |
| 5,113,112 A | | 5/1992 | Shimoma et al. | 313/412 |
| 5,382,883 A | * | 1/1995 | Chen et al. | 315/368.15 |
| 5,389,855 A | * | 2/1995 | Chen | 315/14 |
| 5,689,158 A | * | 11/1997 | Chen | 315/382.1 |

* cited by examiner

*Primary Examiner*—Don Wong
*Assistant Examiner*—Tuyet T. Vo
(74) *Attorney, Agent, or Firm*—Emrich & Dithmar

(57) ABSTRACT

For use in a beam index color cathode ray tube (CRT), a multi-beam group electron gun directs first and second groups of vertically aligned electron beams on respective parallel, horizontally aligned color phosphor stripes on the CRT's display screen. Each group of electron beams includes three beams, one for each of the three primary colors of red, green and blue. The first and second electron beam groups are horizontally offset from one another, with the upper, intermediate and lower electron beams in each group tracing the same horizontal phosphor stripe as the beams scan the display screen and with a time delay provided to synchronize the video information of both electron beam groups. A color video signal is provided either to a respective cathode or to a respective segmented conductive portion containing a beam passing aperture in the electron gun's $G_1$ control grid for individually modulating each beam with color video image information.

41 Claims, 3 Drawing Sheets

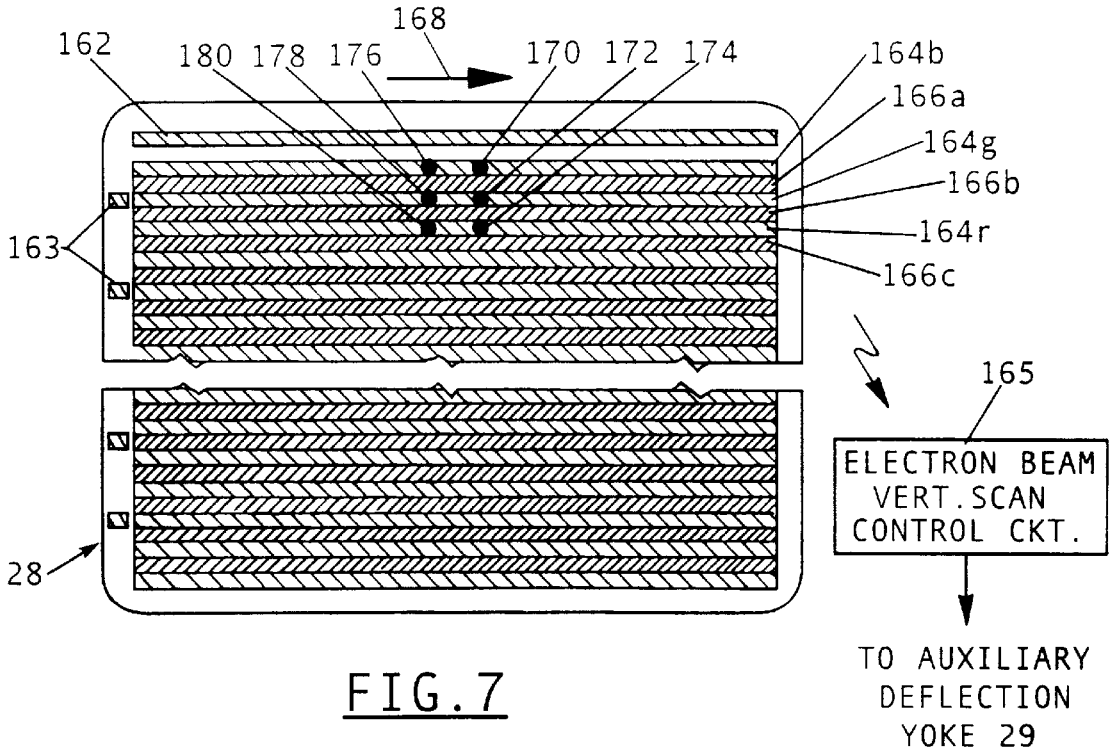
FIG.7
FIG.8
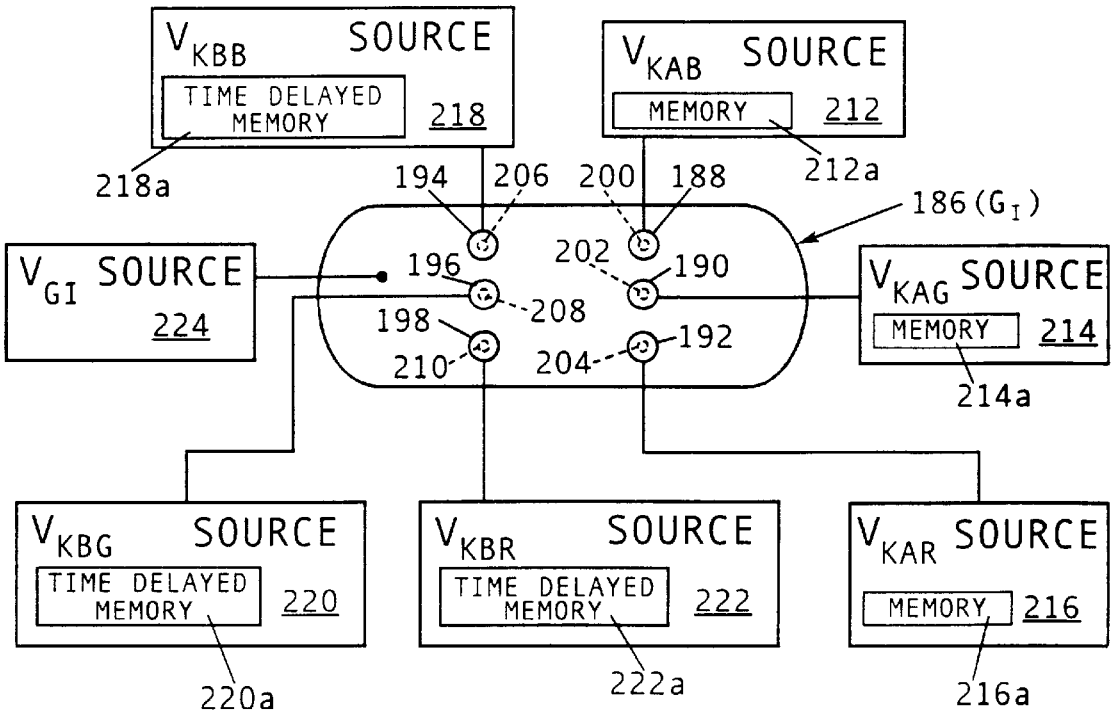

MULTI-BEAM GROUP ELECTRON GUN FOR BEAM INDEX CRT

FIELD OF THE INVENTION

This invention relates generally to multi-electron beam color cathode ray tubes (CRTs) and is particularly directed to a color index CRT wherein plural electron beams are formed in groups prior to incidence upon the CRT's display screen.

BACKGROUND OF THE INVENTION

One type of CRT which does not incorporate a color selection electrode, or shadow mask, employs a large number of narrow substantially parallel phosphor stripes which are arranged in groups of three, with each stripe typically emitting one of the primary colors of red, green or blue. The phosphor stripes may be arranged either vertically or horizontally on the inner surface of the CRT's display screen. Black inoperative stripes are typically disposed intermediate adjacent color emitting stripes. Multiple index stripes are typically disposed on the display screen's inner surface for feedback and determining the position of the electron beam. In the case of vertically oriented phosphor stripes, the horizontal scan of the electron beam requires rapid turning on and turning off of the electron beam at the right instant and at a very high frequency, typically on the order of 10 megahertz. In the case of horizontally aligned phosphor stripes, precise x-axis positioning of the electron beam on the phosphor stripes is required. The present invention relates to the latter case of horizontally aligned, vertically spaced phosphor stripes disposed on the inner surface of the CRT's display screen.

The path of future development in both the shadow mask type and the index type of CRT is in the direction of high definition television (HDTV) displays. Regardless of the CRT configuration, a HDTV display requires a higher frequency magnetic deflection yoke for increased electron beam scan rates and high video image resolution and brightness. Unfortunately, these two operating criteria are interrelated such that improvement in one performance parameter generally comes at the expense of the other.

Increasing the scan frequency of the CRT's magnetic deflection yoke requires higher deflection input power to the yoke as well as a more expensive yoke assembly. To provide acceptable brightness and resolution in a large 16:9 color CRT, higher beam current and improved video image resolution are required. These enhancements typically require a larger CRT envelope neck size to accommodate a larger electron gun. Increasing the size of the CRT envelope is contrary to current trends which seek to reduce the non-display screen portions of the CRT. One approach to providing acceptable image brightness involving the use of higher beam currents employs a dispenser cathode which affords high electron emission densities. However, the use of a dispenser cathode substantially increases the cost of the cathode. While some of the aforementioned approaches have been adopted in HDTV CRT's, the increased cost and complexity of the resulting CRT reduces its commercial competitiveness relative to other HDTV display technologies such as liquid crystal displays (LCDs), plasma display panels (PDPs), etc.

Video image brightness is also a concern in projection television receivers. A conventional electrostatic focusing electron gun cannot meet both the beam spot size (resolution) and brightness operating criteria because of the large size of a projection television receiver display. A combined electro- static and magnetic focusing arrangement is typically employed in a HDTV system, which increases the complexity and cost over that of a conventional electron gun and deflection yoke system. In addition, in a high resolution electron gun due to a high video drive frequency, the capacitance of the cathode has to be reduced to 2 pf, or less, which requires a specialized design of increased cost.

The present invention addresses the aforementioned limitations of the prior art by providing a multi-beam group electron gun for beam index CRTs which employs two or more groups of horizontally spaced, vertically aligned electron beams, where each electron beam in a group scans a respective color producing horizontal phosphor stripe. This allows each phosphor stripe to be impinged upon by two horizontally spaced electron beams during each horizontal scan of the CRT's display screen. A video time delay is used to permit the video information written by the horizontally spaced, vertically aligned electron beam groups to be correlated correctly.

OBJECTS AND SUMMARY OF THE INVENTION

Accordingly, it is an object of the present invention to provide a color index CRT with an electron gun having grouped electron beams, with each group of electron beams providing a portion of a video image on the CRT's display screen.

It is another object of the present invention to increase the number of video image forming electron beams in a color CRT of the index-type to allow for a reduction in the peak current in each beam without sacrificing video image brightness.

Yet another object of the present invention is to relax magnetic deflection yoke and cathode emission requirements in a color index CRT while maintaining high electron beam spot resolution without increasing CRT neck size or deflection power requirements.

A further object of the present invention is to store received color video information for subsequent recall and display after a predetermined time period on a portion of a CRT's display screen adjacent to where real time video information is being displayed for the purpose of increasing the portion of the video image displayed with each horizontal scan of the CRT screen.

A still further object of the present invention is to increase by a factor of two the brightness of a video image in a beam index color CRT without increasing electron beam current by doubling the number of electron beams in the CRT.

It is yet another object of the present invention to reduce electron beam spot size in a beam index color CRT for improved video image resolution.

This invention contemplates an electron gun for a color index cathode ray tube (CRT) having a display screen with a plurality of horizontally aligned, vertically spaced phosphor stripes, wherein a video image is formed by sweeping a plurality of electron beams over the phosphor stripes in a raster-like manner, wherein each electron beam provides one of the three primary colors of red, green or blue of the video image, the electron gun comprising: a cathode for providing energetic electrons; a beam forming region (BFR) disposed adjacent the cathode and including first and second spaced, charged grids, wherein each of the grids includes first and second vertically aligned, grouped arrays of apertures for forming the electron beams into a first leading and a second trailing group of electron beams as said electron beams are swept over the display screen, and wherein the first leading and the second trailing groups of electron beams are horizontally spaced from one another, with the electron beams in each group in vertical alignment and directed onto a respective phosphor stripe for providing one of the primary colors; a lens disposed intermediate the BFR and the CRT's display screen for focusing the electron beams on the display screen; and a plurality of video signal sources coupled to either the cathode or to one of the grids in the BFR for providing color video signals thereto in modulating each of the electron beams in accordance with the color video signals; and a circuit for delaying the video signals displayed by the first leading group of electron beams relative to the video signals displayed by the second trailing group of electron beams in synchronizing the display of those portions of a video image formed by the first leading and second trailing groups of electron beams.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 7 is a partial elevation view of a display screen used in a color index CRT incorporating an electron gun in accordance with the present invention illustrating the scanning of the display screen's horizontally aligned phosphor stripes by multi-beam groups of electron beams in accordance with the present invention; and FIG. 8 is an aft elevation view of a $G_1$ control grid and multi-cathode combination for use in another embodiment of a multi-beam group electron gun in accordance with the present invention showing each of the cathodes coupled to a respective video signal source in simplified block diagram form.

DETAILED DESCRIPTION OF THE PREFERRED EMBODIMENTS

Figure 1:
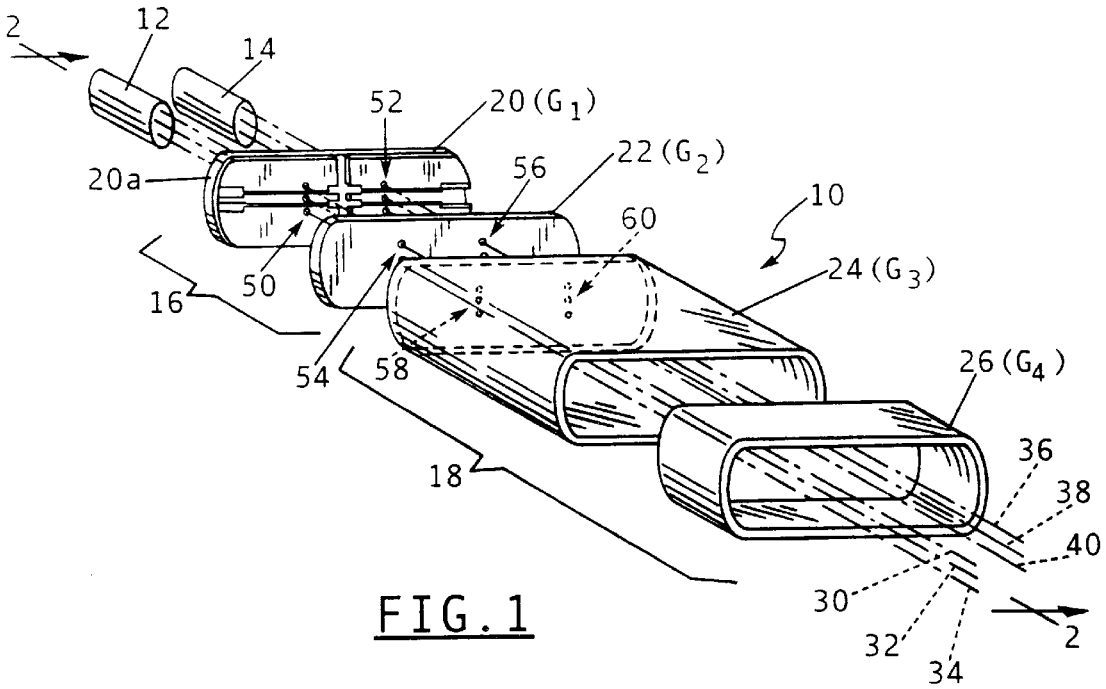
FIG. 1 is a simplified isometric view shown partially in phantom of an electron gun in accordance with the principles of the present invention.
Figure 2:
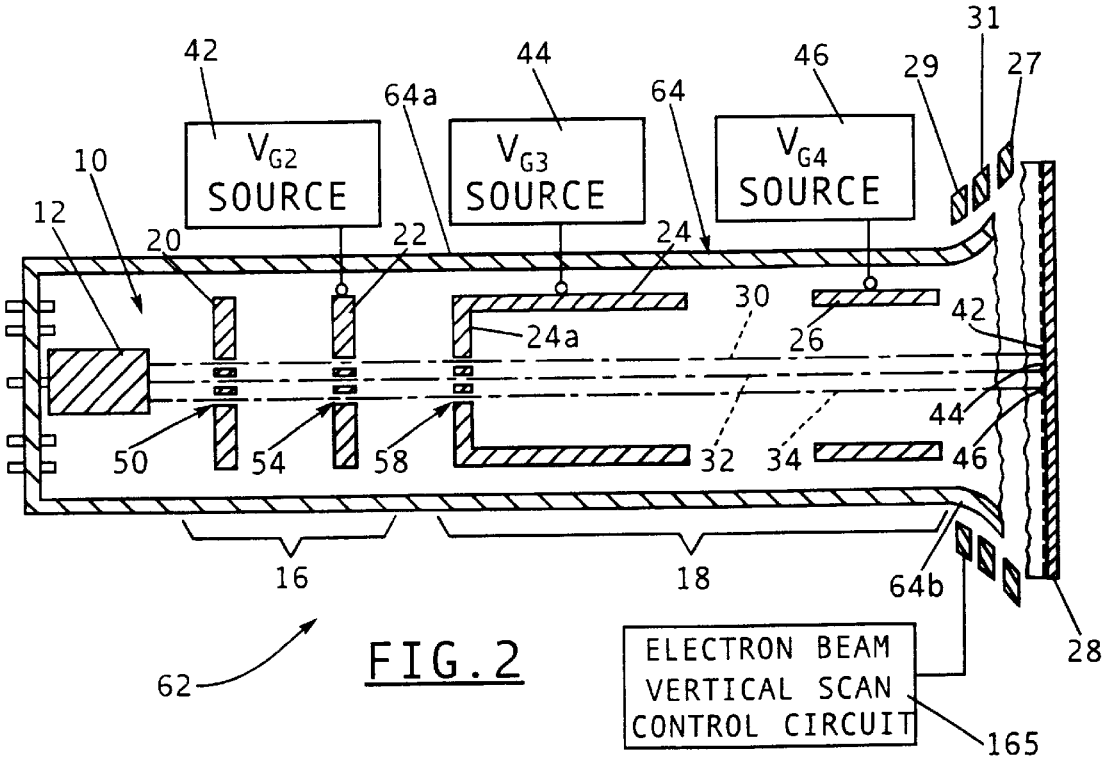
FIG. 2 is a longitudinal sectional view of the inventive electron gun of FIG. 1 shown partially in simplified block diagram form taken along site line 2—2 in FIG. 1.
Figure 3:
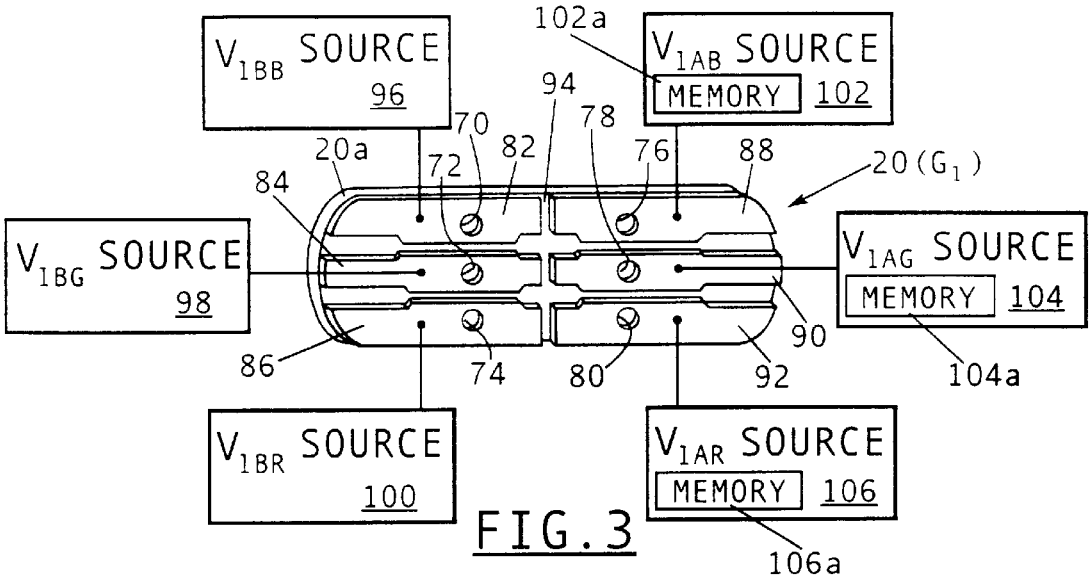
FIG. 3 is a front perspective view of the $G_1$ control grid employed in the electron gun of FIG. 1 further showing various color video signal sources coupled to the $G_1$ control grid.
Figure 4:
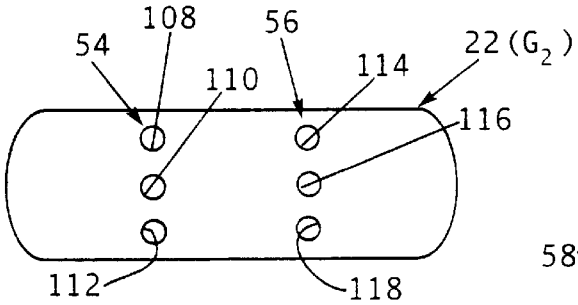
FIGS. 4 and 5 are elevation views of the $G_2$ screen grid and the $G_3$ grid, respectively, employed in the electron gun of FIG. 1.
Figure 5:
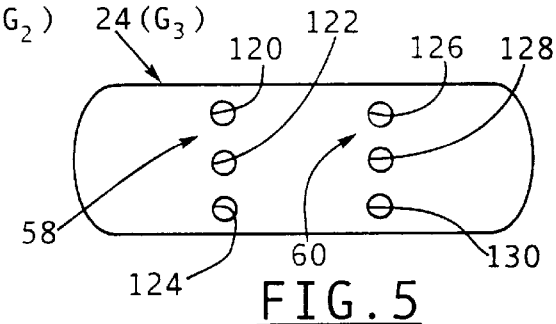

Referring to FIG. 1, there is shown a simplified isometric view partially in phantom of a multi-beam group electron gun 10 for use in a color index CRT in accordance with the principles of the present invention. FIG. 2 is a partial longitudinal vertical sectional view of the multi-beam group electron gun 10 shown in FIG. 1 taken along site line 2—2 therein which also illustrates in simplified block diagram form the various voltage sources coupled to the various charged grids of the electron gun when incorporated in a color index CRT 62. Electron gun 10 is of the bi-potential type and includes a pair of inline cathodes 12 and 14 for providing two groups of energetic electrons in the direction of a $G_1$ control grid 20. Additional details of the $G_1$ control grid 20 are shown in the front perspective view of FIG. 3 and are described below. The $G_1$ control grid 20 in combination with a $G_2$ screen grid 22 provides a beam forming region (BFR) 16 in electron gun 10 for forming the energetic electrons into a first group of vertically aligned electron beams 30, 32 and 34 and a second group of vertically aligned electron beams 36, 38 and 40. Electron gun 10 further includes a $G_3$ grid 24 and a $G_4$ grid 26 which, in combination, form a high voltage focusing lens 18 for focusing the electron beams on the display screen 28 of the color index CRT 62. Disposed on the inner surface of display screen 28 are a plurality of a vertically spaced, horizontally aligned phosphor stripes, where three of the stripes are shown as elements 42, 44 and 46. In FIG. 2, electron beams 30, 32 and 34 in the first group of electron beams are shown as respectively incident upon blue, green and red phosphor stripes 42, 44 and 46. The color index CRT 62 further includes a glass envelope 64, as is conventional, comprised of a cylindrical neck portion 64*a* within which electron gun 10 is disposed in a funnel portion 64*b* attached to the display screen 28. Disposed about the CRT's funnel portion 64*b* is a magnetic deflection yoke 27 for simultaneously displacing the six electron beams over the inner surface of the display screen 28 in a raster pattern. A dynamic magnetic quadruple 31 is also disposed about the CRT's funnel portion 64*b* for maintaining the electron beams in convergence as the beams are displaced in unison over the entire display screen 28.

The $G_1$ control grid 20 is in the general form of a flat plate having first and second horizontally spaced groups of vertically aligned apertures 50 and 52 for passing the six electron beams 30, 32, 34, 36, 38 and 40. The $G_2$ screen grid 22 is also in the general form of a flat plate having a first and second pairs of horizontally spaced, vertically aligned apertures 54 and 56. The $G_1$ control grid 20 is comprised of a non-conductive ceramic substrate 20*a*.

The $G_3$ grid 24 includes a panel 24*a* on its lower end which also includes six beam passing apertures in the form of a first group of vertically aligned apertures 58 and second group of vertically aligned apertures 60. The three apertures in the $G_3$ grid's first group of beam passing apertures 58 are aligned with the first groups of beam passing apertures 50 and 54 in the $G_1$ control and $G_2$ screen grids 20 and 22. Similarly, each aperture in the $G_3$ grid's second group of beam passing apertures 60 is aligned with a respective aperture in the second groups of beam passing apertures 52 and 56 in the $G_1$ control and $G_2$ screen grids 20 and 22. Thus, the first groups of beam passing apertures in the $G_1$ control, $G_2$ screen and $G_3$ grids pass vertically aligned electron beams 30, 32 and 34. Similarly, the beam passing apertures in each of the second groups of apertures in the $G_1$ control, $G_2$ screen: and $G_3$ grids 20, 22 and 24 pass electron beams 36, 38 and 40. The two upper electron beams are incident upon a blue phosphor stripe 42, while the intermediate and lower pairs of electron beams are respectively incident upon green and red phosphor stripes 44 and 46 as shown in FIG. 2. As indicated above, the vertically spaced, horizontally aligned phosphor stripes on the inner surface of the CRT's display screen 28 are arranged in groups of three, with each stripe in each group providing one of the primary colors of red, green or blue.

The $G_2$ Screen Grid 22 is coupled to and charged by a $V_{G2}$ Source 42 for proper biasing of the electron beams.

Similarly, the $G_3$ Grid 24 is coupled to and charged by a focus voltage ($V_{G3}$) source 44 for focusing the electron beams on the display screen 28, while the $G_4$ grid 26 is coupled to and charged by an accelerating voltage ($V_{G4}$) source 46 for accelerating the electrons toward the display screen. The $G_3$ and $G_4$ grids 24, 26 form a common lens arrangement in electron gun 10 through which all of the electron beams are directed.

The $G_1$ control grid 20 further includes six thin conductive portions 82, 84, 86, 88, 90 and 92 on its front surface. The conductive portions are formed on the $G_1$ Control grid's ceramic substrate 20*a* by affixing a thin conductive metallic layer to the surface of the ceramic substrate such as by brazing or cramping. A portion of the conductive layer is then removed in a conventional manner such as by chemical etching so as to form a continuous non-conductive insulating gap 94 separating the various conductive portions. Insulating gap 94 exposes the underlying ceramic substrate 20*a* and defines the six aforementioned conductive portions 82, 84, 86, 88, 90 and 92. Each of the conductive portions 82, 84, 86, 88, 90 and 92 encloses a respective one of the $G_1$ control grid's beam passing apertures 70, 72, 74, 76, 78 and 80 allowing each of the electron beams to be individually modulated by a respective video signal provided to each of the conductive portions as described below.

Coupled respectively to the first three conductive portions 82, 84 and 86 are $V_{1bb}$, $V_{1bg}$ and $V_{1br}$ video signal sources 96, 98 and 100. Similarly, coupled respectively to the second group of conductive portions 88, 90 and 92 are $V_{1ab}$, $V_{1ag}$ and $V_{1ar}$ video signal sources 102, 104 and 106. Each of the aforementioned video signal sources provides a respective video signal to its associated conductive portion for modulating the electron beam passing through the aperture within that particular conductive portion. Thus, the $V_{1ab}$, $V_{1ag}$ and $V_{1ar}$ video signal sources 102, 104 and 106 respectively modulate the electron beams passing through apertures 76, 78 and 80. Similarly, the $V_{1bb}$, $V_{1bg}$ and $V_{1br}$ video signal sources 96, 98 and 100 respectively modulate the electron beams passing through apertures 70, 72 and 74. The $V_{1AB}$, $V_{1AG}$ and $V_{1AR}$ video signal sources 102, 104 and 106 include respective memories 102*a*, 104*a*, and 106*a* which store video image information for providing a time delay between the color video information contained in the trailing three electron beams relative to the color video information contained in the leading three electron beams. In this manner a first portion of a video image on the CRT's display screen is provided by the three electron beams passing through the vertically aligned beam passing apertures 76, 78 and 80, while an adjacent, laterally displaced portion of the video image is simultaneously provided by the trio of electron beams passing through apertures 70, 72 and 74.

Figure 6:
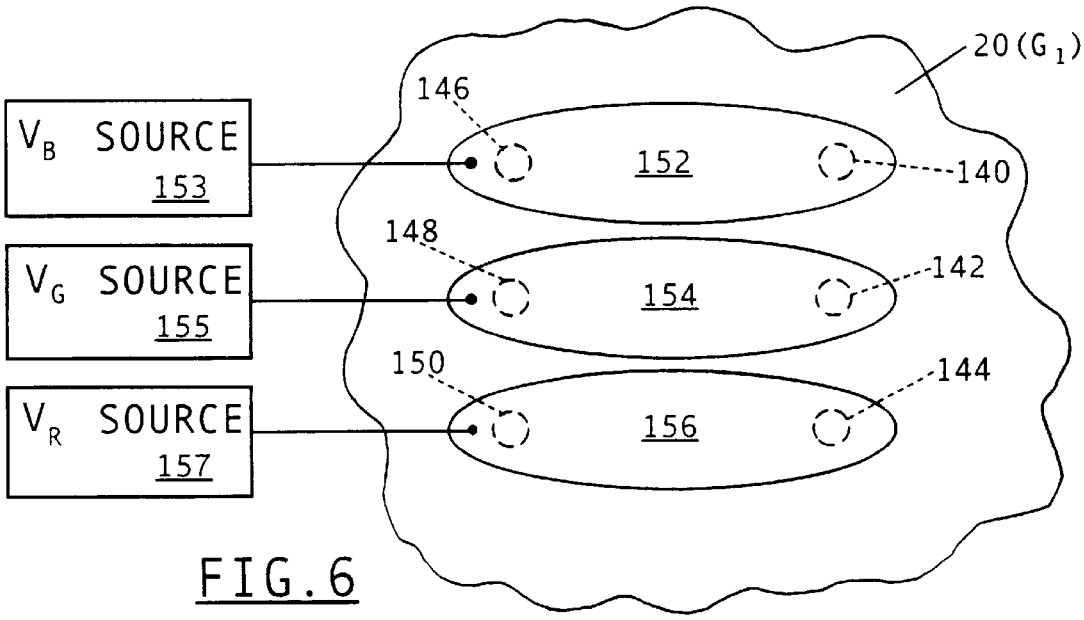
FIG. 6 is a partial aft elevation view of the $G_1$ control grid illustrating another cathode arrangement for use in the electron gun of the present invention.

Referring to FIG. 6, there is shown an aft view of an electron gun illustrating details of its $G_1$ control grid 20 in combination with three cathodes 152, 154 and 156 in accordance with another embodiment of the present invention. As in the previously described embodiment, the $G_1$ control grid 20 includes a first group of three vertically aligned apertures 146, 148 and 150 and a second group of three vertically aligned apertures 140, 142 and 144, where the first and second groups of apertures are horizontally separated and the apertures are shown in dotted line form. In the embodiment shown in FIG. 6, three vertically aligned, horizontally elongated cathodes 152, 154 and 156 are respectively disposed aft of and in alignment with the two uppermost apertures 146, 140, the two intermediate apertures 148, 142, and the two lowermost apertures 150 and 144. The uppermost cathode 152 provides energetic electrons directed through beam passing apertures 146 and 140 for incidence upon an upper blue phosphor stripe which is not shown in the figure for simplicity. Similarly, the intermediate and lowermost cathodes 154 and 156 respectively direct energetic electrons through paired apertures 148, 142 and 150, 144 for providing electron beams which are respectively incident upon green and red phosphor stripes which also are not shown in the figure for simplicity. Thus, the uppermost, intermediate and lowermost cathodes 152, 154 and 156 are the source of respective pairs of electron beams which are directed upon blue, green and red phosphor stripes, respectively. The uppermost cathode 152 is coupled to a $V_B$ (blue) bias voltage source 153, while the intermediate and lowermost cathodes 154 and 156 are respectively coupled to $V_G$ (green) and $V_R$ (red) bias voltage sources 155 and 157.

Referring to FIG. 7, there is shown a simplified elevation view of the CRT's display screen 28 and the manner in which a video image is formed thereon by means of the electron gun shown in FIGS. 1 and 2. Disposed adjacent the upper edge of the display screen 160 and aligned generally horizontally is a linear, elongated beam location index stripe 162. The beam location index stripe 162 is responsive to incidence of an electron beam thereon and provides an output signal in response thereto. The output signal from the beam location index stripe 162 may be either in the form of an electrical signal on a conductor or an emitted UV signal which is provided via an electron beam vertical scan control circuit 165 to an auxiliary deflection yoke 29 disposed about the electron beams adjacent the funnel portion 64*b* of the CRTs glass envelope 64 for aligning the electron beams with the phosphor stripes on the CRT's display screen 28. The top scan of the display screen 28 is typically performed by turning off the upper and lower electron beams and permitting the intermediate electron beam to be incident upon the beam location index stripe 162. The aforementioned correction signal provided to the auxiliary deflection yoke 29 centers the intermediate, or middle, electron beam on the beam location index stripe 162. In this manner, the three vertically aligned electron beams are aligned with the horizontal groups of three color producing phosphor stripes along the height of the display screen 28 from top to bottom.

Plural beam location index elements 163 may also be provided at the left-hand end, or lead-in portion, of respective phosphor stripes as shown in FIG. 7 to provide an enhanced electron beam alignment capability. In this embodiment, at the start of each horizontal sweep the upper and lower electron beams are turned OFF and the middle electron beam (typically the green electron beam) remains ON as it is directed onto one of the beam location index elements 163 before the electron beams reach the left-hand ends of adjacent phosphor stripes. The beam location index elements output a vertical correction signal to the auxiliary deflection yoke 29 via the electron beam vertical scan control circuit 165 for providing fine Y-axis beam position adjustment in centering the middle electron beams on the beam location index element. Vertical adjustment of the position of the electron beams is based on the average Y-axis position of the two electron beam groups. Once the middle electron beams are centered on a beam location index element and as the horizontal sweep of the three electron beams continues, the upper and lower electron beams are turned on as they transit the left-hand end of adjacent horizontal phosphor stripes. The beam location index elements are contemplated for use in combination with the beam index line 162, with every third horizontal phosphor line provided with an associated beam location index element. The beam location index elements 163 provide for precise alignment of both groups of three vertically aligned election beams with their associated horizontal phosphor lines. In addition, when an electron beam is incident upon a beam location index element as it is swept horizontally across the display screen, a lead-in time reference signal is generated. A lead-in time reference signal is generated for each group of vertically aligned electron beams, with the two lead-in time reference signals used to check and adjust a digital time delay between the two vertically aligned electron beam groups. It is this digital time delay which is used to synchronize the display of those portions of the video image formed by the leading and trailing groups of electron beams.

In FIG. 7, the first three color producing phosphor stripes are identified as elements 164*b* (blue), 164*g* (green), and 164*r* (red). Disposed intermediate the blue and green producing phosphor stripes 164*b*, 164*g* is a first black stripe 166*a*, while disposed intermediate the green and red producing phosphor stripes 164*g*, 164*r* is a second black stripe 166*b*. A third black stripe 166*c* is disposed between the red producing phosphor stripe 164*r* and the next lower color producing phosphor stripe.

The upper pair of electron beams 170 and 176 scan the blue phosphor stripe 164*b* in the direction of arrow 168, while the middle and lower pairs of electron beams 172, 178 and 174, 180 respectively scan the green and red phosphor stripes 164*g* and 164*r* in the same direction. The six electron beams scan the display screen 28 in a conventional raster pattern by means of the aforementioned magnetic deflection yoke 27 as described above and shown in FIG. 2. In practice, the electron beams would be much more closely spaced together than as shown in FIG. 7 which is intended as an illustration of the concept of the present invention. When the electron beams reach the right-hand margin of the display screen 28, they are quickly deflected leftward to begin tracing the second trio of color producing phosphor stripes on the display screen. Upon completion of the scanning of the bottom three phosphor stripes on the display screen 28, the first and second groups of electron beams undergo retrace by means of the aforementioned magnetic deflection yoke and are positioned so as to initiate retrace of the first trio of color producing phosphor stripes 164*b*, 164*g* and 164*r*. By simultaneously tracing each color producing trio of phosphor stripes with a plurality of electron beams, electron beam scan frequency and deflection frequency rate may be reduced together with the deflection yoke power requirements. This allows for the use of a simpler, cheaper magnetic deflection yoke. The reduction in beam scan frequency gives rise to a corresponding increase in the "dwell time" of the electron beams on the display screen's phosphor elements. Increasing electron beam dwell time allows for a corresponding reduction in electron beam peak current density giving rise to a corresponding improvement in electron beam spot size and video image resolution without sacrificing video image brightness.

Referring to FIG. 8, there is shown an aft, elevation view of a $G_1$ control grid 186 and multi-cathode arrangement for use in another embodiment of an electron gun in accordance with the present invention. The $G_1$ control grid 186 is shown in combination with six cathodes 188, 190, 192, 194, 196 and 198. As shown in the figure, the $G_1$ control grid 186 includes a 2×3 matrix of apertures shown in dotted-line form including a second group of vertically aligned, beam passing apertures 200, 202 and 204 and a first group of vertically aligned, beam passing apertures 206, 208 and 210. Cathodes 188, 190 and 192 are respectively aligned with the second group of apertures 200, 202 and 204, while cathodes 194, 196 and 198 are respectively aligned with beam passing apertures 206, 208 and 210 in the first group of apertures. The $G_1$ control grid 186 is preferably comprised of a conductive metal and is biased by a $V_{G1}$ voltage source 224. Each of the cathodes when heated generates a respective plurality of energetic electrons which are directed through an associated aperture in the $G_1$ control grid 186. In this manner, six spaced electron beams arranged in a 2×3 matrix are formed by the $G_1$ control grid 186 and are directed toward a $G_2$ screen grid in the electron gun which is not shown in the figure for simplicity. The election beams associated with cathodes 194, 196 and 198 are the leading electron beams, while the electron beams associated with cathodes 188, 190 and 192 are the trailing electron beams.

Each of the cathodes is coupled to and energized by a respective video signal source. Thus, each of the cathodes in the second group of cathodes 188, 190 and 192 is respectively coupled to $V_{KAB}$, $V_{KAG}$ and $V_{KAR}$ video signal sources 212, 214 and 216. Similarly, each of the cathodes in the first group of cathodes 194, 196 and 198 is respectively coupled to the $V_{KBB}$, $V_{KBG}$ and $V_{KBR}$ video signal sources 218, 220 and 222. Each of the video signal sources provides a modulating signal to its associated cathode for controlling the electrons emitted by the cathode and the resulting color video image formed by the electron beam. Each of the video signal sources coupled to a cathode in the second group of cathodes includes a respective memory for storing video data which is read from the video memory and provided to an associated cathode. Thus, the $V_{KAB}$, $V_{KAG}$ and $V_{KAR}$ video signal sources 212, 214 and 216 respectively include video memories 212*a*, 214*a* and 216*a*. Video memories allow the video signal sources associated with different horizontal scan lines to temporarily store video data, such as in a received television signal, for subsequent recall and simultaneous display with the video data associated with the first group of cathodes 194, 196 and 198. Temporary storage of data in the video memories allows the data to be read from the memories and provided to each of the first group of cathodes 194, 196 and 198 such that the first, or leading, group of three electron beams scanning the CRT's display screen provide video image information which is synchronous with that provided in the second group of electron beams driven by the $V_{KAB}$, $V_{KAG}$ and $V_{KAR}$ video signal sources 212, 214 and 216. More specifically, video information in a received television signal for the first group of three electron beams would respectively be stored in memories 218*a*, 220*a* and 222*a* and subsequently provided to each of the cathodes 194, 196 and 198 in the first group of cathodes synchronously with the video data provided on a realtime basis in each of the electron beams in the first group of beams by the first group of cathodes 194, 196 and 198 as the six electron beams are swept horizontally across the CRT's display screen. The video memories, in effect, provide a time delay between the color video information contained in the trailing three electron beams relative to the color video information contained in the leading three electron beams for proper correlation of the video information contained in the two groups of electron beams.

There has thus been shown a multi-beam group electron gun for a color beam index CRT which includes a beam forming region including adjacent charged grids each having a plurality of beam passing apertures which are arranged into first and second groups of vertically aligned apertures, where the two groups of apertures are horizontally spaced from one another. In the disclosed embodiment, each group includes three vertically aligned apertures for passing electron beams which provide the primary colors of blue, green and red on the CRT's display screen. In one embodiment, the color video information in each beam is controlled by a respective video signal source coupled to a cathode, where each beam passing aperture in the charged grids has an associated electron producing cathode. In another embodiment, two or three cathodes direct energetic electrons onto the two groups of vertically aligned apertures for directing the electron beams onto the display screen. In the later embodiment, video signal color information is provided to conductive portions on the electron gun's $G_1$ control grid, where each grid conductive portion includes a beam passing aperture for modulating the electron beam in accordance with the color video signal provided to the grid's conductive portion. The two horizontally spaced groups of vertically aligned electron beams simultaneously scan the video display in a raster pattern. The two upper paired electron beams, two middle paired electron beams, and the two lower paired electron beams each scan a respective color generating phosphor stripe. A delay is introduced in the video signal information displayed by the three leading electron beams in the first group so that the video information presented in these three beams is synchronous with the video information provided in the three trailing electron beams in the second group of beams. Video memory is provided for temporarily storing the video data provided to the first three leading beams which is subsequently read from the memories introducing the aforementioned delay for synchronizing the display of information by the two groups of electron beams. Simultaneously providing color video image information by plural groups of vertically aligned, horizontally spaced multi-beam group arrays allows for a reduction in horizontal scan frequency and associated magnetic deflection yoke operating criteria, and also increases beam dwell time on the screen's phosphor elements allowing for a reduction in individual beam current without sacrificing video image brightness while improving video image resolution. Employing plural sets of primary color-producing electron beams also permits video image brightness to be maintained using reduced current in each electron beam or allows for increased video image brightness using the same current in each electron beam. Finally, the inventive multi-beam group electron gun allows for a reduction in electron beam spot size while maintaining video image brightness for improved video image resolution.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An electron gun for a color index cathode ray tube (CRT) having a display screen with a plurality of horizontally aligned, vertically spaced phosphor stripes, wherein a video image is formed by sweeping a plurality of electron beams over said phosphor stripes in a raster-like manner, wherein each electron beam provides one of the three primary colors of red, green or blue of the video image, said electron gun comprising:

a cathode for providing energetic electrons;

a beam forming region (BFR) disposed adjacent to said cathode and including first and second spaced, charged grids, wherein each of said grids includes first and second vertically aligned, grouped arrays of apertures for forming said electron beams into a first leading and a second trailing group of electron beams as said electron beams are swept over the display screen, and wherein said first leading and said second trailing groups of electron beams are horizontally spaced from one another, with the electron beams in each group in vertical alignment and directed onto a respective phosphor stripe for providing one of the primary colors;

a lens disposed intermediate said BFR and the CRT's display screen for focusing the electron beams on the display screen; and a plurality of video signal sources coupled to either said cathode or to one of said grids in said BFR for providing color video signals thereto in modulating each of said electron beams in accordance with said color video signals; and a circuit for delaying the video signals displayed by said first leading group of electron beams relative to the video signals displayed by said second trailing group of electron beams in synchronizing the display of those portions of a video image formed by said first leading and second trailing groups of electron beams.

2. The electron gun of claim 1 further comprising three video signal sources and wherein said cathode includes three cathodes each coupled to a respective one of said video signal sources for providing three pluralities of energetic electrons in forming two groups of three vertically aligned electron beams, wherein each electron beam in each group of electron beams provides one of the primary colors of red, green or blue on the display screen.

3. The electron gun of claim 2 wherein each of said plural cathodes provides energetic electrons to respective apertures in said first and second arrays of apertures.

4. The electron gun of claim 3 wherein said three cathodes are arranged in a vertically stacked array.

5. The electron gun of claim 1 wherein said cathode includes first and second cathodes for providing first and second pluralities of energetic electrons to said first and second vertically aligned arrays of apertures.

6. The electron gun of claim 5 wherein said first and second arrays of apertures each include three vertically aligned, grouped apertures for passing first, second and third vertically aligned electron beams for each of the primary colors of red, green or blue.

7. The electron gun of claim 6 wherein said first grid includes first and second pluralities of vertically spaced, horizontally aligned charged conductive portions each respectively including an aperture of said first or second arrays of apertures and having essentially equal capacitance, wherein said first leading group of electron beams transits said first array of apertures and said second trailing group of electron beams transits said second array of apertures.

8. The electron gun of claim 7 wherein said first grid further includes a non-conductive portion disposed intermediate said plurality of charged conductive portions.

9. The electron gun of claim 8 wherein said charged conductive portions are comprised of metal and said non-conductive portion includes a gap disposed between adjacent metal conductive portions.

10. The electron gun of claim 9 further comprising a first plurality of video signal sources each coupled to a respective one of said first charged conductive portions of said first grid and a second plurality of video signal sources each coupled to a respective one of said second charged conductive portions of said first grid for providing respective video signals thereto.

11. The electron gun of claim 10 wherein each of said first plurality of video signal sources includes a memory for storing a received video signal for subsequent display on the display screen by said electron beams.

12. The electron gun of claim 6 wherein said second grid includes third and fourth pluralities of apertures each including three vertically aligned grouped apertures aligned respectively with the apertures in said first and second arrays of apertures in said first grid for passing said first, second and third vertically aligned electron beams.

13. The electron gun of claim 12 wherein said lens includes at least third and fourth charged grids, and wherein said third grid includes fourth and fifth arrays of apertures each including three vertically aligned, grouped apertures aligned with said first and second arrays of apertures in said first grid for passing first, second and third vertically aligned electron beams.

14. The electron gun of claim 13 wherein said first and second charged grids are a $G_1$ control grid and a $G_2$ screen grid, respectively.

15. The electron gun of claim 14 wherein said third and fourth charged grids are a $G_3$ grid and a $G_4$ grid, respectively.

16. The electron gun of claim 15 wherein said electron gun is a bi-potential electron gun.

17. The electron gun of claim 15 wherein said electron gun is a quadruple electron gun.

18. A color index cathode ray tube (CRT) having a glass envelope including a display screen having a plurality of horizontally aligned, vertically spaced phosphor stripes and a magnetic deflection yoke for displacing the electron beams across the display screen, wherein a video image is formed by sweeping a plurality of electron beams over said phosphor stripes in a raster-like manner, wherein each electron beam provides one of the three primary colors of red, green or blue of the video image, said index CRT comprising:

an electron gun comprising:

a cathode for providing energetic electrons;

a beam forming region (BFR) disposed adjacent to said cathode and including first and second spaced, charged grids, wherein each of said grids includes first and second vertically aligned, grouped arrays of apertures for forming said electron beams into a first leading and a second trailing group of electron beams as said electron beams are swept over the display screen, and wherein said first leading and said second trailing groups of electron beams are horizontally spaced from one another, with the electron beams in each group in vertical alignment and directed onto a respective phosphor stripe for providing one of the primary colors;

a lens disposed intermediate said BFR and the CRT's display screen for focusing the electron beams on the display screen; and a plurality of video signal sources coupled to either said cathode or to one of said grids in said BFR for providing color video signals thereto in modulating each of said electron beams in accordance with said color video signals;

a circuit for delaying the video signals displayed by said first leading group of electron beams relative to the video signals displayed by said second trailing group of electron beams in synchronizing the display of those portions of a video image formed by said first leading and second trailing groups of electron beams; and a beam index location element on the display screen responsive to an electron beam incident thereon for providing a deflection signal to the magnetic deflection yoke for maintaining the electron beams in alignment with the horizontally aligned, vertically spaced phosphor stripes.

19. The index CRT of claim 18 wherein said beam index location element is a horizontal index stripe dispose above the phosphor stripes.

20. The index CRT of claim 19 wherein said horizontal index stripe is disposed adjacent an upper edge of the display screen and extends substantially the entire width of the display screen.

21. The index CRT of claim 19 further comprising an auxiliary vertical magnetic deflection yoke and an electron beam vertical scan control circuit coupled to said auxiliary vertical magnetic deflection yoke and responsive to said deflection signal from said beam location element for providing a deflection control signal to the auxiliary vertical magnetic deflection yoke.

22. The index CRT of claim 21 wherein said beam location element comprises plural beam location index elements each disposed adjacent an end of a respective phosphor stripe where an electron beam begins its sweep over phosphor stripe.

23. The index CRT of claim 21 wherein said beam control elements are disposed adjacent the ends of phosphor stripes of one of said primary colors.

24. The index CRT of claim 22 further comprising an electron beam vertical scan control circuit coupled to said auxiliary vertical magnetic deflection yoke and responsive to said deflection signal from said beam location element for providing a deflection control signal to said auxiliary vertical magnetic deflection yoke.

25. The index CRT of claim 24 wherein said deflection control signal is derived from a UV feedback signal.

26. The index CRT of claim 18 further comprising three video signal sources and wherein said cathode includes three cathodes each coupled to a respective one of said video signal sources for providing three pluralities of energetic electrons in forming two groups of three vertically aligned electron beams, wherein each electron beam in each group of electron beams provides one of the primary colors of red, green or blue on the display screen.

27. The index CRT of claim 26 wherein each of said plural cathodes provides energetic electrons to respective apertures in said first and second arrays of apertures.

28. The index CRT of claim 27 wherein said three cathodes are arranged in a vertically stacked array.

29. The index CRT of claim 18 wherein said cathode includes first and second cathodes for providing first and second pluralities of energetic electrons to said first and second vertically aligned arrays of apertures.

30. The index CRT of claim 29 wherein said first and second arrays of apertures each include three vertically aligned, grouped apertures for passing first, second and third vertically aligned electron beams for each of the primary colors of red, green or blue.

31. The index CRT of claim 30 wherein said first grid includes first and second pluralities of vertically spaced, horizontally aligned charged conductive portions each respectively including an aperture of said first or second arrays of apertures and having essentially equal capacitance, wherein said first leading group of electron beams transits said first array of apertures and said second trailing group of electron beams transits said second array of apertures.

32. The index CRT of claim 31 wherein said first grid further includes a non-conductive portion disposed intermediate said plurality of charged conductive portions.

33. The index CRT of claim 32 wherein said charged conductive portions are comprised of metal and said non-conductive portion includes a gap disposed between adjacent metal conductive portions.

34. The index CRT of claim 33 further comprising a first plurality of video signal sources each coupled to a respective one of said first charged conductive portions of said first grid and a second plurality of video signal sources each coupled to a respective one of said second charged conductive portions of said first grid for providing respective video signals thereto.

35. The index CRT of claim 34 wherein each of said first plurality of video signal sources includes a memory for storing a received video signal for subsequent display on the display screen by said electron beams.

36. The index CRT of claim 30 wherein said second grid includes third and fourth pluralities of apertures each including three vertically aligned grouped apertures aligned respectively with the apertures in said first and second arrays of apertures in said first grid for passing said first, second and third vertically aligned electron beams.

37. The index CRT of claim 36 wherein said lens includes at least third and fourth charged grids, and wherein said third grid includes fourth and fifth arrays of apertures each including three vertically aligned, grouped apertures aligned with said first and second arrays of apertures in said first grid for passing first, second and third vertically aligned electron beams.

38. The index CRT of claim 37 wherein said first and second charged grids are a $G_1$ control grid and a $G_2$ screen grid, respectively.

39. The index CRT of claim 38 wherein said third and fourth charged grids are a $G_3$ grid and a $G_4$ grid, respectively.

40. The index CRT of claim 39 wherein said electron gun is a bi-potential electron gun.

41. The index CRT of claim 39 wherein said electron gun is a quadrupole focusing electron gun.

* * * * *

UNITED STATES PATENT AND TRADEMARK OFFICE

CERTIFICATE OF CORRECTION

PATENT NO. : 6,377,003 B1
DATED : April 23, 2002
INVENTOR(S) : Chen et al.

It is certified that error appears in the above-identified patent and that said Letters Patent is hereby corrected as shown below:

Title page,
Item [73], Assignee, change "Chungwa" to -- Chunghwa --

Signed and Sealed this

Tenth Day of August, 2004

JON W. DUDAS
*Acting Director of the United States Patent and Trademark Office*